US007679487B1

(12) United States Patent
Smith et al.

(10) Patent No.: US 7,679,487 B1
(45) Date of Patent: Mar. 16, 2010

(54) SYSTEM AND METHOD FOR KEEPING TRACK OF REAL-TIME DATA PERTAINING TO SCORES AND WAGERING INFORMATION OF SPORTING ACTIVITIES

(76) Inventors: Gil R. Smith, 11219 Highview Dr., Alta Loma, CA (US) 91737; Marvin R. Clark, 11333 N. 92nd St., unit 2032, Scottsdale, AZ (US) 85260

( * ) Notice: Subject to any disclaimer, the term of this patent is extended or adjusted under 35 U.S.C. 154(b) by 519 days.

(21) Appl. No.: 11/655,688

(22) Filed: Jan. 19, 2007

Related U.S. Application Data

(60) Provisional application No. 60/760,356, filed on Jan. 20, 2006.

(51) Int. Cl.
*G07C 1/00* (2006.01)
*G07C 1/24* (2006.01)

(52) U.S. Cl. ..... 340/323 R; 340/573.1; 340/825.69; 463/42; 700/91; 700/92; 700/93

(58) Field of Classification Search ..... 340/323 R, 340/573.1, 825.69; 436/42; 700/91, 92, 700/93

See application file for complete search history.

(56) References Cited

U.S. PATENT DOCUMENTS

| | | | | |
|---|---|---|---|---|
| 5,557,717 | A | 9/1996 | Wayner | |
| 5,812,049 | A | 9/1998 | Uzi | |
| 6,020,851 | A | 2/2000 | Busack | |
| 6,041,266 | A * | 3/2000 | Nickerson | 700/92 |
| 6,148,242 | A * | 11/2000 | Descalzi et al. | 700/90 |
| 6,725,107 | B2 * | 4/2004 | MacPherson | 700/92 |
| 6,840,861 | B2 * | 1/2005 | Jordan et al. | 463/42 |

* cited by examiner

*Primary Examiner*—Davetta W Goins

(57) ABSTRACT

A system and method for electronically displaying real-time data pertaining to scores and wagering information of live sporting activities includes a score board with electronically adaptable cells displaying alphanumeric values. The cells are grouped into corresponding columns and rows associated with unique predetermined parameters, and are displayed in a central region of the score board. Data input ports are formed about a periphery of the score board for establishing an internet connection. A mechanism displays real-time data pertaining to sports scores and sports wagering activities within the cells such that the real-time data is categorized into a plurality of groups based upon the predetermined parameters so that the real-time data is easily read and understood by the user.

6 Claims, 4 Drawing Sheets

SYSTEM AND METHOD FOR KEEPING TRACK OF REAL-TIME DATA PERTAINING TO SCORES AND WAGERING INFORMATION OF SPORTING ACTIVITIES

CROSS REFERENCE TO RELATED APPLICATIONS

This application claims the benefit of U.S. Provisional Application No. 60/760,356, filed Jan. 20, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to score boards and, more particularly, to a system and method for keeping track of real-time data pertaining to scores and wagering information of sporting activities.

2. Prior Art

Much like the Thanksgiving and Christmas holidays, championship sporting events tend to be popular occasions for friends, family, and even strangers to come together in camaraderie and celebration. Whether hosting a party on Super Bowl Sunday, gathering after a midday meal to watch the big race, or converging on the local sports bar to catch the final game of the World Series, people are inspired to join together to cheer their favorite athletes or teams to victory.

Rooting for the odds-on favorite or hoping for a thrilling upset, sports enthusiasts look forward to the excitement and surprises that are sure to occur during championship events. To add to the fun, many sports fans engage in friendly, high spirited wagering. From broad pontifications such as which team will win the game to more challenging guesses such as point spreads, sports betting encompasses a wide range of factors, from the statistics of each event to the number of bettors and amount of wagers, that can be quite challenging to track when organizing a large betting pool. Having recognized the potential for a technologically advanced, interactive means of keeping track of statistics and betting information during championship sporting events, the present invention was developed.

One prior art example shows a score board specifically suited by design for accumulating and displaying points during the play of games like cribbage, rummy or five hundred euchre but not limited to these. The present inventions are very "pocket-able" or conveniently portable score boards. Unfortunately, this prior art example does not provide a means of tracking scores and wagers for sporting events shown on television. In addition, this prior art example does have the capability of connecting to the internet for obtaining real-time scores and statistics.

Another prior art example shows an apparatus and an associated method for ensuring accurate scoring at a sporting event by associating controls of a score board with the colors worn by the teams, or the positions of the goals (e.g., goals in a basketball tournament). In one implementation, the apparatus alerts a scorekeeper when a play condition reaches a threshold. Unfortunately, this prior art example does not allow a user to display multiple scores and wagers simultaneously, and also does not have the capability of connecting to the internet for obtaining real-time scores and statistics.

Accordingly, a need remains for a system and method for keeping track of real-time data pertaining to scores and wagering information of sporting activities in order to overcome the above-noted shortcomings. The present invention satisfies such a need by providing a device that is convenient and easy to use, is lightweight yet durable in design, and allows a user to easily track scores and wagers of sporting activities. Such a system and method provides sports enthusiasts with an exciting and effective means of keeping track of information during sporting events. The device easily organizes and maintains a plethora of important statistics, such as scores, betting participants, and wagers. The device is accurate, and also provides all users with information at a glance. The present invention is simple to use, inexpensive, and designed for many years of repeated use.

BRIEF SUMMARY OF THE INVENTION

In view of the foregoing background, it is therefore an object of the present invention to provide a system and method for keeping track of real-time data pertaining to scores and wagering information of sporting activities. These and other objects, features, and advantages of the invention are provided by an a system for electronically displaying real-time data pertaining to scores and wagering information of live sporting activities.

The system includes an electronic score board including a plurality of electronically adaptable cells independently displaying alphanumeric values. Selected ones of such cells are grouped into corresponding columns and rows associated with unique predetermined parameters, and are arranged in an equal number of columns and rows displayed in a central region of the score board for designating individuals for random square designations. The system further includes a plurality of data input ports formed about a periphery of the score board for allowing a user to directly connect an electronic peripheral device to the score board and thereby establish an internet connection.

The system further includes a mechanism for displaying real-time data pertaining to sports scores and sports wagering activities within the cells such that the real-time data is categorized into a plurality of groups based upon the predetermined parameters so that the real-time data is easily read and understood by the user. Such a real-time data displaying mechanism includes a dedicated communications link for facilitating transmission of input data generated by the user and output data received in response to the input data, and a remotely monitored network server connected to the score board via the dedicated communications link. Such communications links include a server communications link selected from the group including TCP/IP and HTTP. The network server keeps track of the real-time data. A real-time data interface circuit requests and retrieves the real-time data based upon the user input, and includes a processor electrically coupled to the real-time data interface circuit and the data input ports, and a memory electrically coupled to the processor. Such a memory includes software instructions that cause the system to display the real-time data on the score board cells.

The software instructions include and execute a control logic algorithm including the steps of, requesting the user to activate a transmission sequence with the scoreboard and with the network server, transmitting a request to the network server for a real-time data application module to be uploaded onto the memory, receiving and parsing a network server response with the request to transmit the real-time data application module and, where appropriate, a random number for authentication purposes. Each packet of the real-time data has a minimum quantity of embedded information relating to one of the real-time data parameters. The steps further include sending an appropriate command to the processor in order to retrieve the real-time data and, where appropriate, a random number, and receiving the command and uploading the real-time data onto the cells. The real-time data is stored in the nonvolatile memory of the data interface circuit.

The method for electronically displaying real-time data pertaining to scores and wagering information of live sporting activities includes an electronic score board including a plurality of electronically adaptable cells independently displaying alphanumeric values. Selected ones of such cells are grouped into corresponding columns and rows associated with unique predetermined parameters, and are arranged in an equal number of columns and rows displayed in a central region of the score board for designating individuals for random square designations.

The method further includes providing a plurality of data input ports formed about a periphery of the score board for allowing a user to directly connect an electronic peripheral device to the score board and thereby establish an internet connection. Such peripheral devices include one electronic device selected from the group including a cellular telephone, a keyboard, a laptop and any combination thereof. Each of such peripheral devices is wirelessly linked to the internet via the communications link selected from the group including TCP/IP and HTTP.

The method further includes a mechanism for displaying real-time data pertaining to sports scores and sports wagering activities within the cells such that the real-time data is categorized into a plurality of groups based upon the predetermined parameters so that the real-time data is easily read and understood by the user. Such a real-time data displaying mechanism includes providing a dedicated communications link for facilitating transmission of input data generated by the user and output data received in response to the input data, and providing a remotely monitored network server connected to the score board via the dedicated communications link. The network server keeps track of the real-time data. A real-time data interface circuit requests and retrieves the real-time data based upon the user input. Such a real-time data interface circuit includes a processor electrically coupled to the real-time data interface circuit and the data input ports, and a memory electrically coupled to the processor. Such a memory includes software instructions that cause the system to display the real-time data on the score board cells.

The software instructions include and execute a control logic algorithm including the steps of, requesting the user to activate a transmission sequence with the scoreboard and with the network server, transmitting a request to the network server for a real-time data application module to be uploaded onto the memory, and receiving and parsing a network server response with the request to transmit the real-time data application module and, where appropriate, a random number for authentication purposes. Each packet of the real-time data has a minimum quantity of embedded information relating to one of the real-time data parameters. The steps further include sending an appropriate command to the processor in order to retrieve the real-time data and, where appropriate, a random number, and receiving the command and uploading the real-time data onto the cells. Such real-time data is stored in the nonvolatile memory of the data interface circuit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
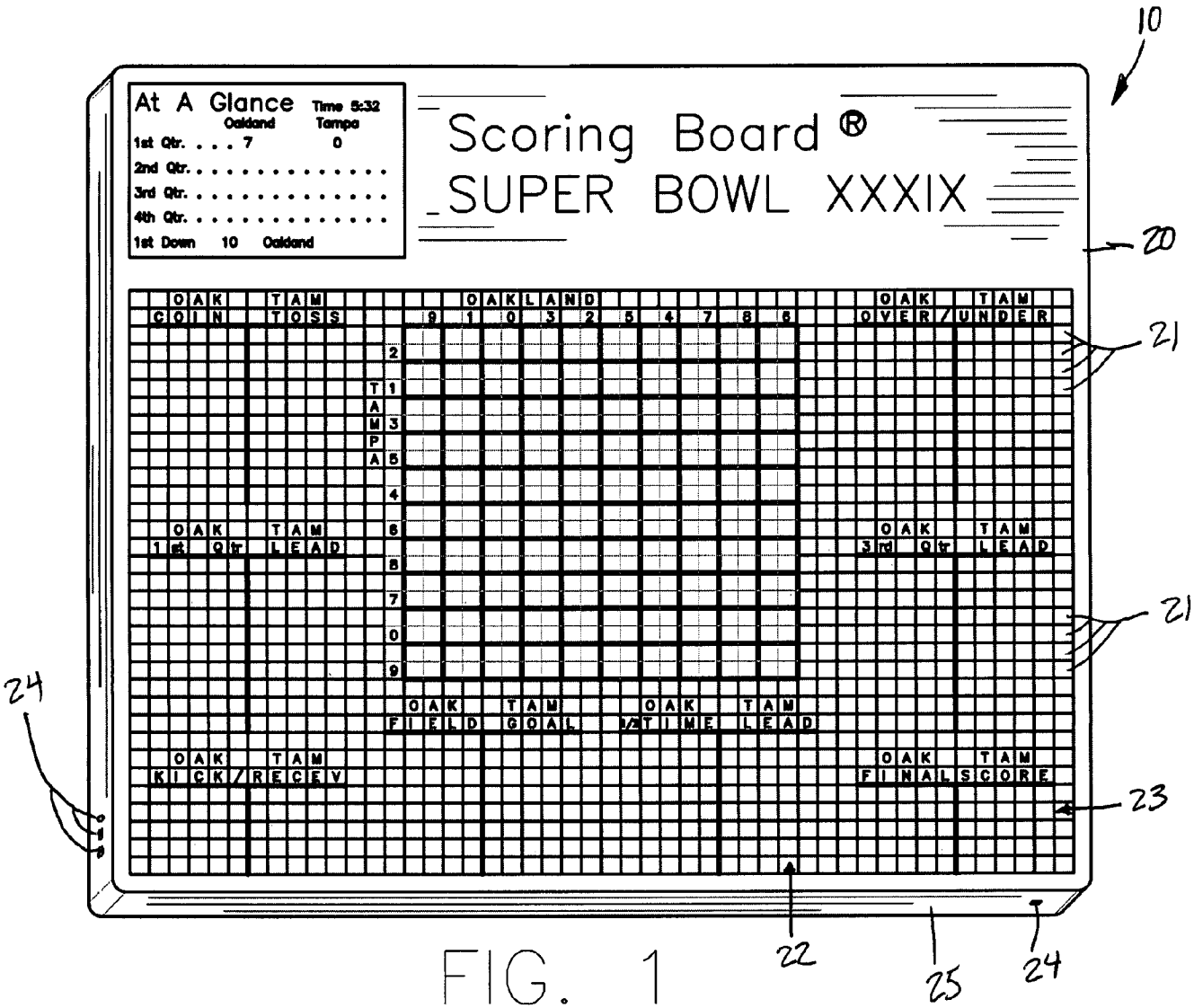
FIG. 1 is a perspective view of a score board, in accordance with the present invention.
Figure 2:
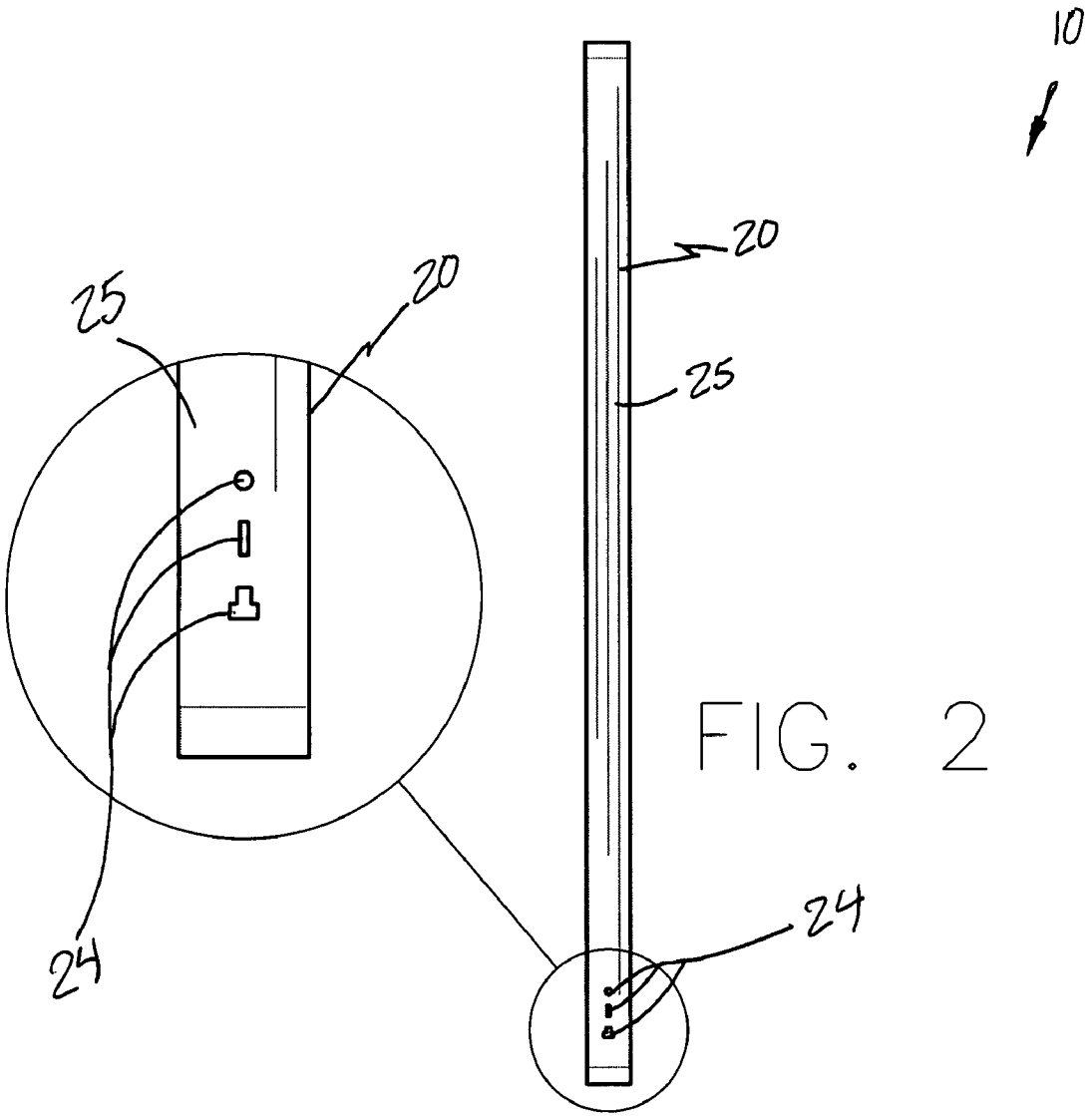
FIG. 2 is a side elevational view of the score board shown in FIG. 1, showing an expanded view of a data input port for receiving a computer, PDA, and cell phone, as examples.
Figure 3:
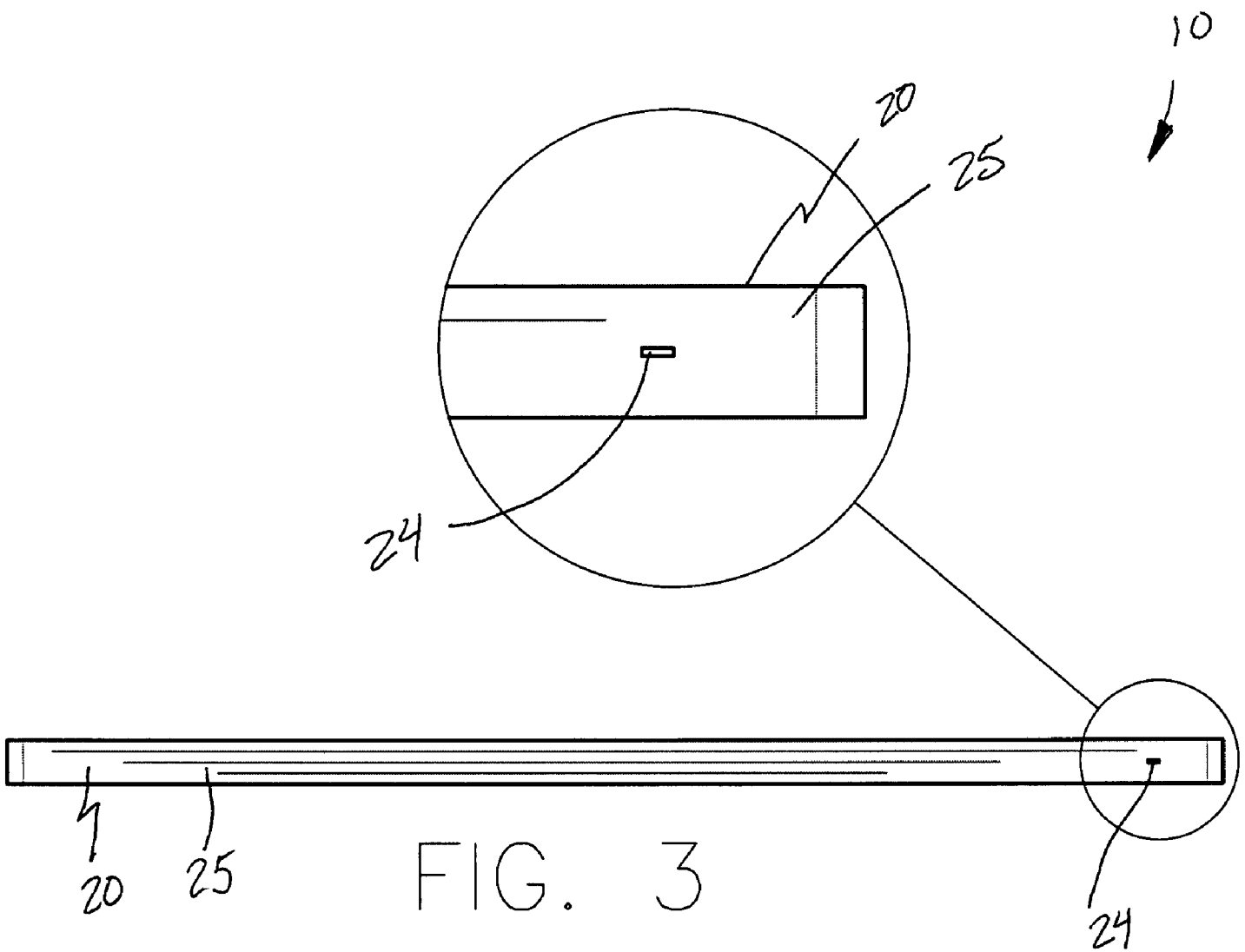
FIG. 3 is a bottom edge view of the score board shown in FIG. 1, showing an expanded view of another data input port for receiving a keyboard, as an example.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-4 by the reference numeral 10 and is intended to provide a system and method for keeping track of real-time data pertaining to scores and wagering information of sporting activities. It should be understood that the device 10 may be used to keep track of many different types of scores and wagers and should not be limited in use to keeping track of only those types of scores and wagers described herein.

Referring initially to FIGS. 1, 2, 3, and 4, the system 10 includes an electronic score board 20 including a plurality of electronically adaptable cells 21 independently displaying alphanumeric values. Selected ones of such cells 21 are grouped into corresponding columns 22 and rows 23 associated with unique predetermined parameters, and are arranged in an equal number of columns 22 and rows 23 displayed in a central region of the score board 20, which is essential for designating individuals for random square designations. Such a display allows a user to quickly and easily determine which scores and wagers pertain to the specific sporting activity of interest. The system 10 further includes a plurality of data input ports 24 advantageously formed about a periphery 25 of the score board 20, which is critical for allowing a user to directly connect an electronic peripheral device 26 to the score board 20, without the use of intervening elements, and thereby establish an internet connection. By connecting to the internet, a user can input a multitude of separate values from different sporting activities as they occur.

Figure 4:
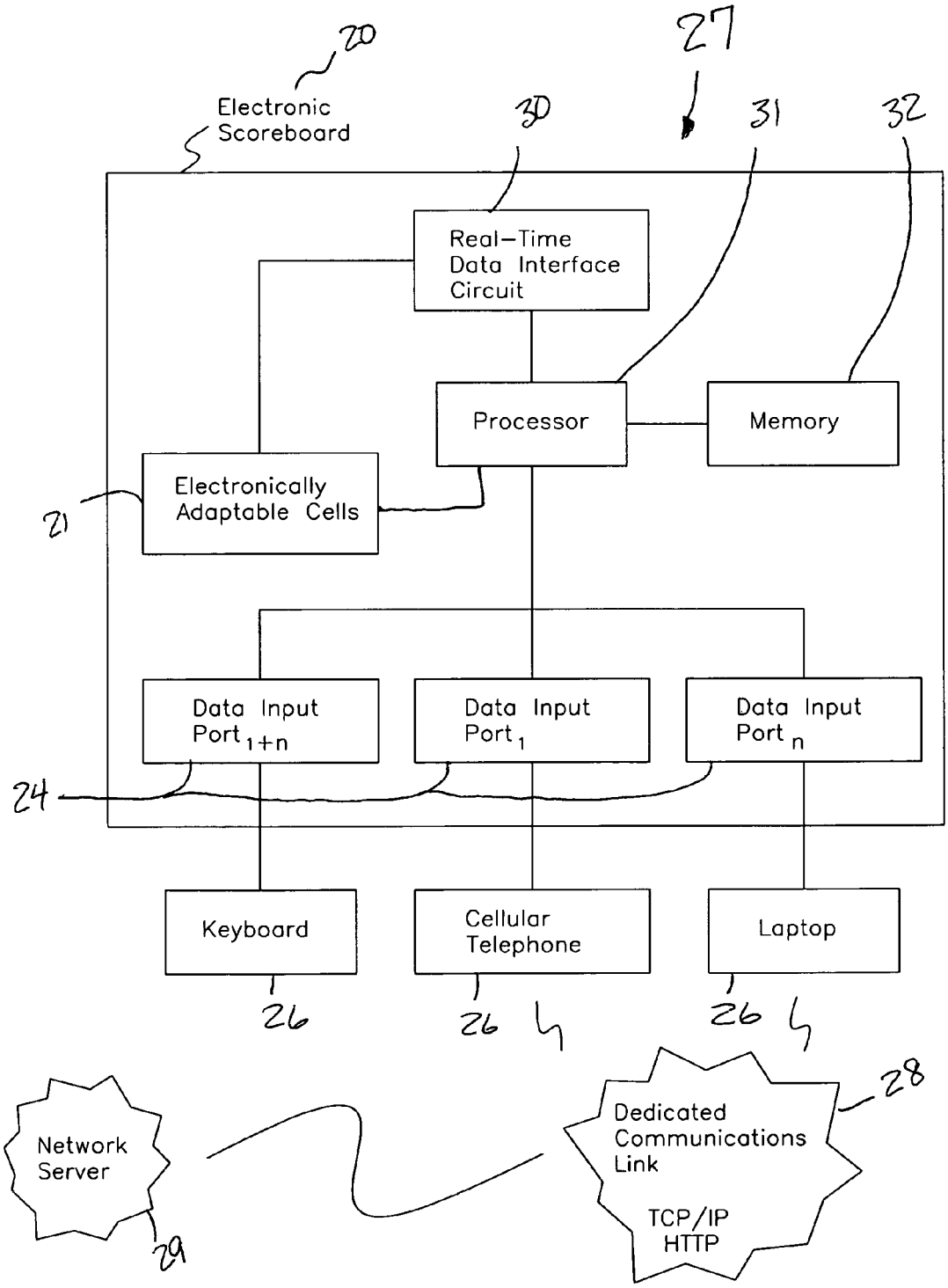
FIG. 4 is a schematic block diagram of the real-time data displaying mechanism.

Referring to FIG. 4, the system 10 further includes a mechanism 27 for displaying real-time data pertaining to sports scores and sports wagering activities within the cells 21, which is crucial such that the real-time data is advantageously categorized into a plurality of groups based upon the predetermined parameters so that the real-time data is easily read and understood by the user. Such a real-time data displaying mechanism 27 includes a dedicated communications link 28, which is vital for advantageously facilitating transmission of input data generated by the user and output data received in response to the input data, and a remotely monitored network server 29 connected to the score board 20 via the dedicated communications link 28. Such a dedicated communications link 28 includes a server communications link selected from the group including TCP/IP and HTTP. The network server 29 keeps track of the real-time data. A real-time data interface circuit 30 requests and retrieves the real-time data based upon the user input, and includes a processor 31 electrically coupled to the real-time data interface circuit 30 and the data input ports 24, and a memory 32 electrically coupled to the processor 31. Such a memory 32 includes software instructions that advantageously cause the system 10 to display the real-time data on the cells 21.

Again referring to FIG. 4, the software instructions include and execute a control logic algorithm including the steps of, requesting the user to activate a transmission sequence with the scoreboard 20 and with the network server 29, transmitting a request to the network server 29 for a real-time data application module to be uploaded onto the memory 32, receiving and parsing a network server response with the request to transmit the real-time data application module and, where appropriate, a random number for authentication purposes. Each packet of the real-time data has a minimum quantity of embedded information relating to one of the real-time data parameters. The steps further include sending an appropriate command to the processor 31 in order to retrieve the real-time data and, where appropriate, a random number, and receiving the command and uploading the real-time data onto the cells 21. The real-time data is advantageously stored in the memory 32 of the data interface circuit 30, and is accessed and displayed immediately by the system 10.

The arrangement of columns 22 and rows 23 combined with the ability to establish a dedicated communications link 28 to the internet via a plurality of peripheral devices 26 provides the unexpected benefit of allowing a user to display a multitude of sports activities and wagers in real time on the score board 20, thereby overcoming the shortcomings described in the prior art. In operation, a method 10 for electronically displaying real-time data pertaining to scores and wagering information of live sporting activities includes an electronic score board 20 including a plurality of electronically adaptable cells 21 independently displaying alphanumeric values. Selected ones of such cells 21 are grouped into corresponding columns 22 and rows 23 associated with unique predetermined parameters, and are arranged in an equal number of columns 22 and rows 23 displayed in a central region of the score board 20, which is essential for designating individuals for random square designations. Such a display allows a user to quickly and easily determine which scores and wagers pertain to the specific sporting activity of interest.

The method 10 further includes providing a plurality of data input ports 24 formed about a periphery 25 of the score board 20, which is critical for allowing a user to directly connect an electronic peripheral device 26 to the score board 20, without the use of intervening elements, and thereby establish an internet connection. By connecting to the internet, a user can input a multitude of separate values from different sporting activities as they occur. Such peripheral devices 26 include one electronic device selected from the group including a cellular telephone 26, a keyboard 26, a laptop 26 and any combination thereof. Each of such peripheral devices 26 is wirelessly linked to the internet via a dedicated communications link 28 selected from the group including TCP/IP and HTTP.

The method 10 further includes a mechanism 27 for displaying real-time data pertaining to sports scores and sports wagering activities within the cells 21, which is crucial such that the real-time data is advantageously categorized into a plurality of groups based upon the predetermined parameters so that the real-time data is easily read and understood by the user. Such a real-time data displaying mechanism 27 includes providing a dedicated communications link 28 for facilitating transmission of input data generated by the user and output data received in response to the input data, and providing a remotely monitored network server 29 connected to the score board 20 via the dedicated communications link 28. The network server 29 keeps track of the real-time data. A real-time data interface circuit 30 requests and retrieves the real-time data based upon the user input. Such a real-time data interface circuit 30 includes a processor 31 electrically coupled to the real-time data interface circuit 30 and the data input ports 24, and a memory 32 electrically coupled to the processor 31. Such a memory 32 includes software instructions that cause the system 10 to display the real-time data on the cells 21.

The software instructions include and execute a control logic algorithm including the steps of, requesting the user to activate a transmission sequence with the scoreboard 20 and with the network server 29, transmitting a request to the network server 29 for a real-time data application module to be uploaded onto the memory 32, and receiving and parsing a network server response with the request to transmit the real-time data application module and, where appropriate, a random number for authentication purposes. Each packet of the real-time data has a minimum quantity of embedded information relating to one of the real-time data parameters. The steps further include sending an appropriate command to the processor 31 in order to retrieve the real-time data and, where appropriate, a random number, and receiving the command and uploading the real-time data onto the cells 21. Such real-time data is stored in the memory 32 of the data interface circuit 30, and is accessed and displayed immediately by the system 10.

A better understanding of the system and method of this invention 10 will be gained by reference to the schematic diagram of FIG. 4 wherein the system is seen to include a processor 31 connected for both output and input to the real-time date interface circuit 30 and cells 21. The interface circuit 30 in turn generates output signals to a number of electronically adaptable cells collectively designated at 21 and which may include all of the cells in rows and columns shown in FIG. 1 on the top surface of the electronic scoreboard 20 of this invention. Input signals are generated through the peripheral devices 26 via the data input ports 24, the dedicated communications link 28, as well as the network server 29, respectively. The data input ports 24 interconnect the aforementioned peripheral devices to the processor 31 which is programmed to interrogate the real-time information so as to ascertain the status of individual teams scores and wagering information, and take appropriate action under program control in response to the control logic algorithm listed hereinabove.

In response to the real-time input information derived from the peripheral devices 26 and network server 29 through the data input ports 26, the processor 31 under program control generates an output which is directed through the interface circuit 30 to an appropriate group of selected cells 21, e.g. alphanumeric visual displays shown on the electronic scoreboard 20 and which may consist of the seven segment L.E.D. arrays associated with the dedicated T-shaped categories having predetermined parameters. For example, the keyboard 26 may selectively define various categories and parameters for different games and wagering conditions, as desired by the user, so that when a particular game begins, the processor confirms the game selection by lighting the L.E.D. cells associated with the particular T-shaped category. Of course, a power supply may be connected to each of the processor 31, interface circuit 30 and electronic scoreboard 20 for supplying the required voltage and current to each of these subsystems.

The processor 31 will not be described in detail as a number of suitable processors are presently available off the shelf from various manufacturers and distributors. These processors include on board program memory or separate memory chips into which is stored a program algorithm such as explained hereinabove, and also include the necessary input/output ports through which the processor 31 is interconnected to the interface circuit 30. One example of a suitable readily available processor is the KIM I board which is a well documented board and which can be readily interfaced to data interface circuits, data input ports and output displays such as the electronic scoreboard of FIG. 1. The particular construction of the interface circuit 30 by way of example may include a display driver such which is capable of driving the plurality of 7-segment L.E.D.s of each horizontal display row defined by a group of cells 21 in FIG. 1, for a total of one display driver for each horizontal row. The various peripheral devices 26 are connected to the data input ports 24 of the electronic scoreboard with appropriate debouncing resistor capacitor-networks.

The control logic algorithm program stored on the memory 32 for implementing the real-time team score and wagering information function of the present invention, is described hereinabove. All references to particular cells are in connection with FIG. 1. It will be understood however, that the invention is not limited to the particular arrangement of the scoreboard display screen shown in FIG. 1.

Upon starting the system by logging onto the network server via a secured remote access station, the processor 31 turns off all indicator and display cells to clear the scoreboard 20. The processor 31 then repeatedly interrogates the peripheral devices 26 and upon finding that one of them has been actuated, the processor 31 jumps or branches to the selected game. Selected cells identified by corresponding L.E.D.s in FIG. 1 associated with the actuated game may be lit by the interface circuit 30 and/or processor 31 to confirm selection of the game. The appropriate beginning score is then displayed at a selected row of seven segments L.E.D.s in the T-shaped categories. Thus, for the various games between selected groups of T-shaped categories, the corresponding number will appear on the appropriate cells of 7-segment L.E.D.s in the selected display rows. If a future game that has not started, has been selected, then the beginning score on all numerical displays in arrays is zero.

Next, the processor 31 and interface circuit 30 repeatedly interrogate the real-time application module and the additional information received from the network server until one of them is actuated and activates the corresponding group of cells, respectively if such is provided, to confirm the selection of one or more games. At this point, the processor 31 and interface circuit 30 are ready to accept and parse real-time information from the network server 29 or the keyboard 26 indicative of the individual points scored during a predetermined time-frame by a particular player or team or wagering activities associated with the teams. The processor 31 thus enters into a waiting state during which it repeatedly interrogates the flow of input signals of the network server 29 and/or keyboard 26. When a packet of new information is received, it is entered then transmitted to the interface circuit 30 depending on which team has been selected. After the individual real-time data is parsed, the real-time application module is interrogated. If the real-time data embedded in the application module is not verified, the real-time data is disregarded and a new corrected individual real-time data is accepted and replaces the previous real-time data on the appropriate cells of the scoreboard 20. If the real-time data is accepted while the validation test is incomplete, the processor 31 proceeds to send the real-time data to the interface circuit 30 where the real-time data is compared with prior validated data stored in memory for auditing purposes.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A system for electronically displaying real-time data pertaining to scores and wagering information of live sporting activities, said system comprising:

an electronic score board including a plurality of electronically adaptable cells independently displaying alphanumeric values, selected ones of said cells being grouped into corresponding columns and rows associated with unique predetermined parameters;

a plurality of data input ports formed about a periphery of said score board for allowing a user to directly connect an electronic peripheral device to said score board and thereby establish an internet connection; and means for displaying real-time data pertaining to sports scores and sports wagering activities within said cells such that said real-time data is categorized into a plurality of groups based upon said predetermined parameters so that said real-time data is easily read and understood by the user;

wherein said real-time data displaying means comprises a dedicated communications link for facilitating transmission of input data generated by the user and output data received in response to said input data;

a remotely monitored network server connected to said score board via said dedicated communications link, said network server keeping track of said real-time data; and a real-time data interface circuit for requesting and retrieving said real-time data based upon said user input, said real-time data interface circuit comprising a processor electrically coupled to said real-time data interface circuit and said data input ports; and a memory electrically coupled to said processor, said memory including software instructions that cause said system to display said real-time data on said score board cells;

wherein said software instructions include and execute a control logic algorithm including the steps of a. requesting the user to activate a transmission sequence with said scoreboard and with said network server, b. transmitting a request to said network server for a real-time data application module to be unloaded onto said memory, c. receiving and parsing a network server response with the request to transmit the real-time data application module and, where appropriate, a random number for authentication purposes, each packet of said real-time data having a minimum quantity of embedded information relating to one of said real-time data parameters, d. sending an appropriate command to said processor in order to retrieve said real-time data and, where appropriate, a random number, said real-time data being stored in the nonvolatile memory of said data interface circuit; and e. receiving said command and unloading said real-time data onto said cells.

2. The system of claim 1, wherein said communications link comprises:

a server communications link selected from the group including TCP/IP and HTTP.

3. A system for electronically displaying real-time data pertaining to scores and wagering information of live sporting activities, said system comprising:

an electronic score board including a plurality of electronically adaptable cells independently displaying alphanumeric values, selected ones of said cells being grouped into corresponding columns and rows associated with unique predetermined parameters, wherein selected ones of said cells are arranged in an equal number of columns and rows displayed in a central region of said score board for designating individuals for random square designations;

a plurality of data input ports formed about a periphery of said score board for allowing a user to directly connect an electronic peripheral device to said score board and thereby establish an internet connection; and means for displaying real-time data pertaining to sports scores and sports wagering activities within said cells such that said real-time data is categorized into a plurality of groups based upon said predetermined parameters so that said real-time data is easily read and understood by the user;

wherein said real-time data displaying means comprises a dedicated communications link for facilitating transmission of input data generated by the user and output data received in response to said input data;

a remotely monitored network server connected to said score board via said dedicated communications link, said network server keeping track of said real-time data; and a real-time data interface circuit for requesting and retrieving said real-time data based upon said user input, said real-time data interface circuit comprising a processor electrically coupled to said real-time data interface circuit and said data input ports; and a memory electrically coupled to said processor, said memory including software instructions that cause said system to display said real-time data on said score board cells;

wherein said software instructions include and execute a control logic algorithm including the steps of a. requesting the user to activate a transmission sequence with said scoreboard and with said network server, b. transmitting a request to said network server for a real-time data application module to be unloaded onto said memory, c. receiving and parsing a network server response with the request to transmit the real-time data application module and, where appropriate, a random number for authentication purposes, each packet of said real-time data having a minimum quantity of embedded information relating to one of said real-time data parameters, d. sending an appropriate command to said processor in order to retrieve said real-time data and, where appropriate, a random number, said real-time data being stored in the nonvolatile memory of said data interface circuit; and e. receiving said command and unloading said real-time data onto said cells.

4. The system of claim 3, wherein said communications link comprises:

a server communications link selected from the group including TCP/IP and HTTP.

5. A method for electronically displaying real-time data pertaining to scores and wagering information of live sporting activities, said method comprising:

providing an electronic score board including a plurality of electronically adaptable cells independently displaying alphanumeric values, selected ones of said cells being grouped into corresponding columns and rows associated with unique predetermined parameters, wherein selected ones of said cells are arranged in an equal number of columns and rows displayed in a central region of said score board for designating individuals for random square designations;

providing a plurality of data input ports formed about a periphery of said score board for allowing a user to directly connect an electronic peripheral device to said score board and thereby establish an internet connection, wherein said peripheral devices comprise one electronic device selected from the group including a cellular telephone, a keyboard, a laptop and any combination thereof, each of said peripheral devices being wirelessly linked to the internet via said communications link; and providing means for displaying real-time data pertaining to sports scores and sports wagering activities within said cells such that said real-time data is categorized into a plurality of groups based upon said predetermined parameters so that said real-time data is easily read and understood by the user;

wherein the step of providing said real-time data displaying means comprises the steps of:

providing a dedicated communications link for facilitating transmission of input data generated by the user and output data received in response to said input data;

providing a remotely monitored network server connected to said score board via said dedicated communications link, said network server keeping track of said real-time data; and providing a real-time data interface circuit for requesting and retrieving said real-time data based upon said user input, said real-time data interface circuit comprising a processor electrically coupled to said real-time data interface circuit and said data input ports; and a memory electrically coupled to said processor, said memory including software instructions that cause said system to display said real-time data on said score board cells;

wherein said software instructions include and execute a control logic algorithm including the steps of a. requesting the user to activate a transmission sequence with said scoreboard and with said network server, b. transmitting a request to said network server for a real-time data application module to be unloaded onto said memory, c. receiving and parsing a network server response with the request to transmit the real-time data application module and, where appropriate, a random number for authentication purposes, each packet of said real-time data having a minimum quantity of embedded information relating to one of said real-time data parameters, d. sending an appropriate command to said processor in order to retrieve said real-time data and, where appropriate, a random number, said real-time data being stored in the nonvolatile memory of said data interface circuit; and e. receiving said command and unloading said real-time data onto said cells.

6. The method of claim 5, wherein the step of providing said communications link comprises the step of:

providing a server communications link selected from the group including TCP/IP and HTTP.

* * * * *